US006824425B2

(12) United States Patent
Fan

(10) Patent No.: US 6,824,425 B2
(45) Date of Patent: Nov. 30, 2004

(54) ELECTRICAL CONNECTOR HAVING IMPROVED RETENTION STRUCTURE

(75) Inventor: Chia-Hao Fan, Tu-Chen (TW)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/631,689

(22) Filed: Jul. 30, 2003

(65) Prior Publication Data

US 2004/0219830 A1 Nov. 4, 2004

(30) Foreign Application Priority Data

Apr. 30, 2003 (TW) ..... 92206972 U

(51) Int. Cl.[7] ..... H01R 13/60
(52) U.S. Cl. ..... 439/570; 439/571
(58) Field of Search ..... 439/573, 83, 326, 439/569–572, 79; 29/842

(56) References Cited

U.S. PATENT DOCUMENTS 4,629,278 A 12/1986 Norton et al.
5,971,800 A * 10/1999 Azuma et al. ..... 439/502
6,152,766 A * 11/2000 Wu et al. ..... 439/570
2002/0168893 A1 11/2002 Kasaharu

* cited by examiner

*Primary Examiner*—Alex Gilman
(74) *Attorney, Agent, or Firm*—Wei Te Chung

(57) ABSTRACT

An electrical connector (1) includes an insulative housing (10), a number of electrical terminals (20) received in the insulative housing, and a retention structure (40). The insulative housing includes a pair of support portions (13). Each support portion has an upper side, a lower side opposite to the upper side and an outer side. The retention structure includes a body portion (45), a pair of extensions (430) extending from the body portion and engaging with the insulative housing. The body portion includes a main plate (41), a pair of side portions (43) extending upwardly from two opposite sides of the main plate, a pair of upper portions (44) extending toward each other from the two side portions. The two upper portions and the main plate clamp the upper and lower sides of the support portions. The two side portions clamp the outer sides of the two support portions.

19 Claims, 4 Drawing Sheets

ELECTRICAL CONNECTOR HAVING IMPROVED RETENTION STRUCTURE

BACKGROUND OF THE INVENTION

1. Field of the Invention

The present invention relates to an electrical connector, and particularly to an electrical connector mountable to a substrate such as a printed circuit board or the like.

2. Description of Related Art

In personal computers, electrical connectors are often mounted to printed circuit boards for electrically connecting the printed circuit boards with other devices. A number of methods for fixing the electrical connectors to the printed circuits are known in the art. For example, a method consists of mounting a piece of metal to an electrical connector and soldering the metal to a printed circuit board. However, this soldering arrangement provides a fixing force which is unstable and of low reliability. Another method consists of using a screw which passes through an opening of an electrical connector flange and tightening the screw to a printed circuit board to which the electrical connector is mounted. A problem with this arrangement is that excessive screw-tightening torque can create a compression force which exceeds the physical strength of the electrical connector flange. Consequently, a problem, such as a deformation or a crack in the flange, is caused.

In order to solve the above problems, U.S. Patent Application Publication No. US2002/0168893 A1 discloses a retention structure. The retention structure includes a main body portion defining an opening therein for receiving a screw, a right and a left arm portions extending from two opposite ends of the main body portion for clamping a pair of protruding portions of a connector housing to a printed circuit board, and a mounting flange extending from a side of the main body portion and being inserted into and fixed in an insertion groove of the connector housing. A disadvantage of this retention structure is that the retention structure is secured to the connector housing only by the interference between the mounting flange and end walls of the insertion groove, so the retention structure is apt to be inadvertently taken off from the connector housing by improperly operating during conveying the connector.

Hence, an electrical connector having an improved retention structure is desired.

SUMMARY OF THE INVENTION

An object of the present invention is to provide an electrical connector having improved an retention structure which can be reliably fixed to an insulative housing thereof.

To achieve the above object, an electrical connector in accordance with the present invention comprises an insulative housing defining a plurality of passageways, a plurality of electrical terminals received in the passageways of the insulative housing, and a retention structure. The insulative housing comprises a pair of support portions. Each support portion has an upper side, a lower side opposite to the upper side and an outer side. The retention structure includes a body portion and a pair of extensions extending from the body portion and engaging with the insulative housing. The body portion comprises a main plate, a pair of side portions extending upwardly from two opposite sides of the main plate, a pair of upper portions extending toward each other from the two side portions. The two upper portions and the main plate clamp the upper and lower sides of the two support portions, the two side portions clamp the outer sides of the two support portions.

Other objects, advantages and novel features of the invention will become more apparent from the following detailed description when taken in conjunction with the accompanying drawings.

DETAILED DESCRIPTION OF THE INVENTION

Figure 1:
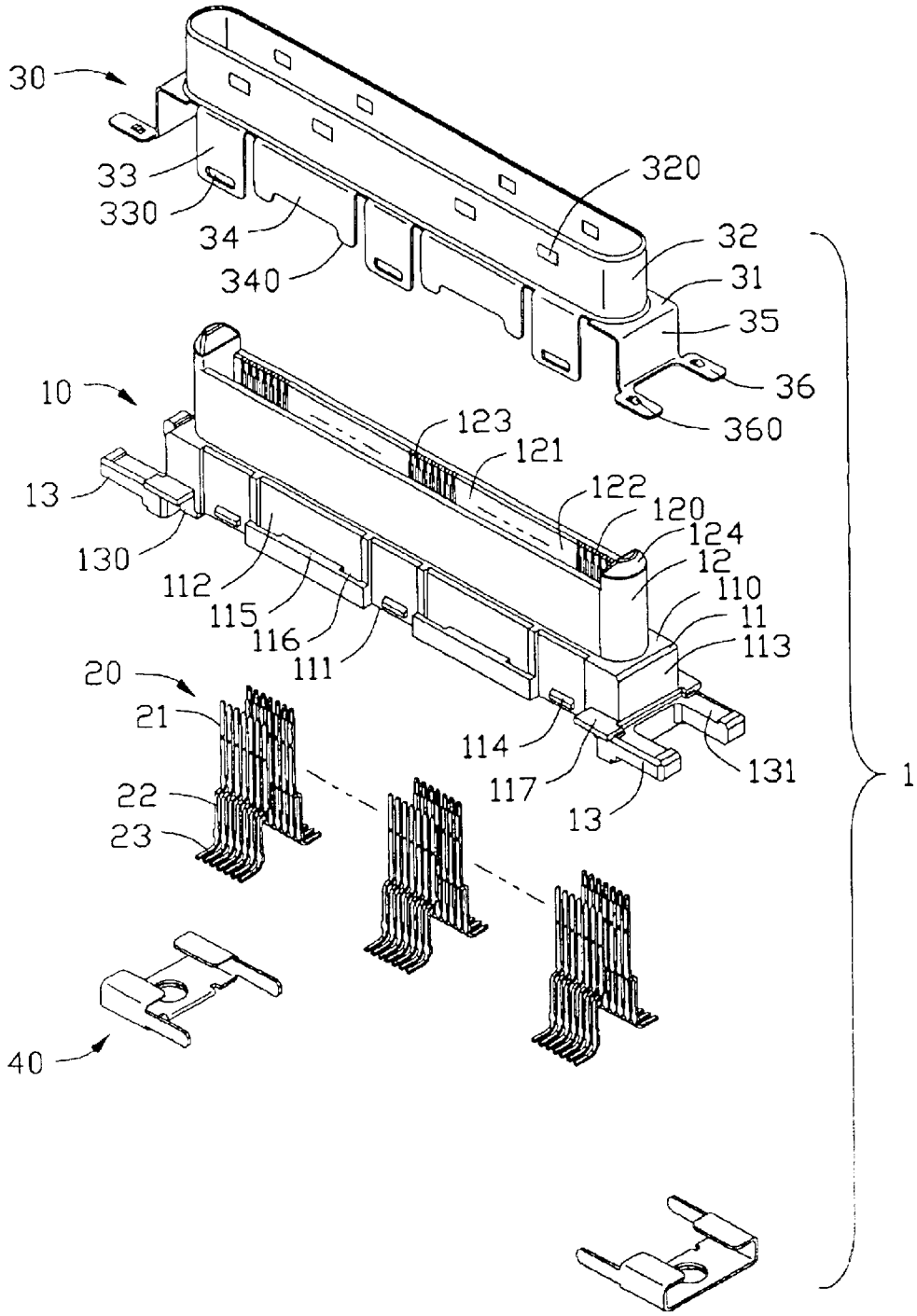
FIG. 1 is an exploded perspective view of an electrical connector in accordance with the present invention.

Referring to FIG. 1, an electrical connector 1 in accordance with the present invention comprises an insulative housing 10, a plurality of electrical terminals 20, a metallic shell 30, and a pair of retention structures 40.

The insulative housing 10 comprises an elongated base 11, a mating portion 12 and two pairs of support portions 13. The base 11 has an upper face 110, a bottom face 111 opposite to the upper face 110, two opposite side faces 112 and two opposite end faces 113. The mating portion 12 extends upwardly from the upper face 110 of the base 11 and defines a top face 120 and a slot 121 extending downwardly from the top face 120 along a longitudinal direction thereof. A plurality of passageways 123 are defined on two opposite side walls 122 of the slot 121. The passageways 123 extend downwardly through the base 11. A pair of guide posts 124 are provided on two opposite ends of the mating portion 12 and extend upwardly beyond the top face 120 of the mating portion 12.

The base 11 is formed with a plurality of projections 114 and flanges 115 on the two opposite side faces 112 thereof. Each flange 115 defines a pair of slits 116 on opposite ends thereof. The base 11 is formed with a pair of plates 117 extending outwardly from two opposite side faces 112 of each end thereof in a direction which is perpendicular to a longitudinal direction of the base 11. Each pair of support portions 13 extend outwardly from an end face 113 of the base 11 along the longitudinal direction of the base 11 and are spaced apart from each other. Each support portion 13 has an upper side, a lower side opposite to the upper side and an outer side. A pair of depressed portions 130 are formed under the pair of plates 117 and adjacent to the pair of support portions 13 on each end of the base 11. Each support portion 13 defines a groove 131.

Each electrical terminal 20 comprises a contact portion 21, a retention portion 22 extending downwardly form the contact portion 21 and a tail portion 23 extending from the retention portion 22.

The metallic shell 30 comprises a main portion 31, a mating port 32 extending upwardly from the main portion 31, a plurality of latch tabs 33 and clips 34 extending downwardly from two opposite sides of the main portion 31, a pair of vertical plates 35 extending downwardly from two opposite ends of the main portion 31, a pair of contact plates 36 horizontally extending from a bottom end of each vertical plate 35. A plurality of projections 320 are stamped on two opposite side walls of the mating port 32. Each latch tab 33 has a opening 330. A pair of protrusions 340 project downwardly from two opposite ends of each clip 34. A resilient tab 360 is stamped from each contact plate 36 and extends upwardly and slantly.

Figure 2:
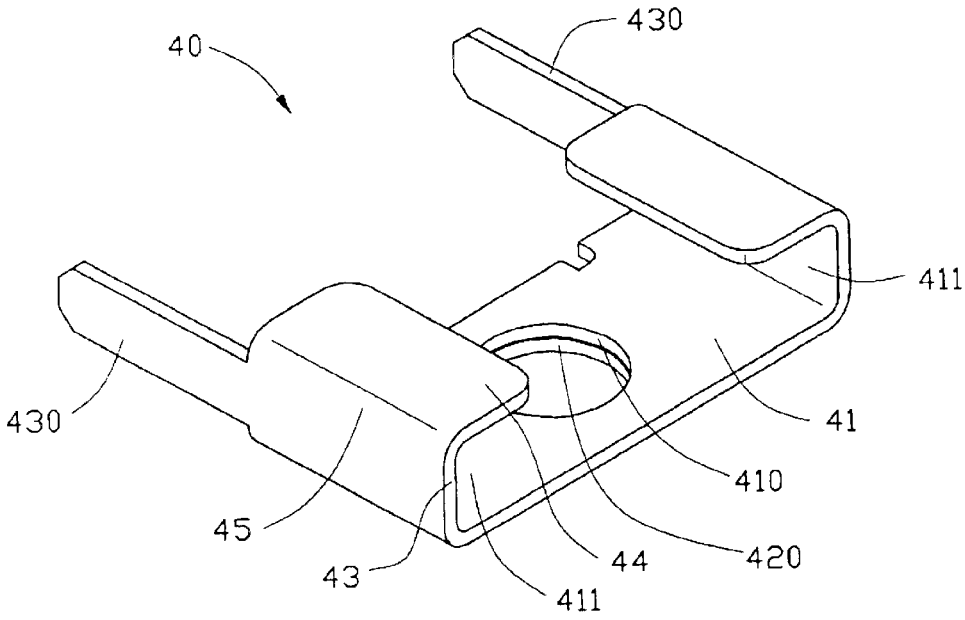
FIG. 2 is an enlarged perspective view of a retention structure of the electrical connector of FIG. 1.
Figure 3:
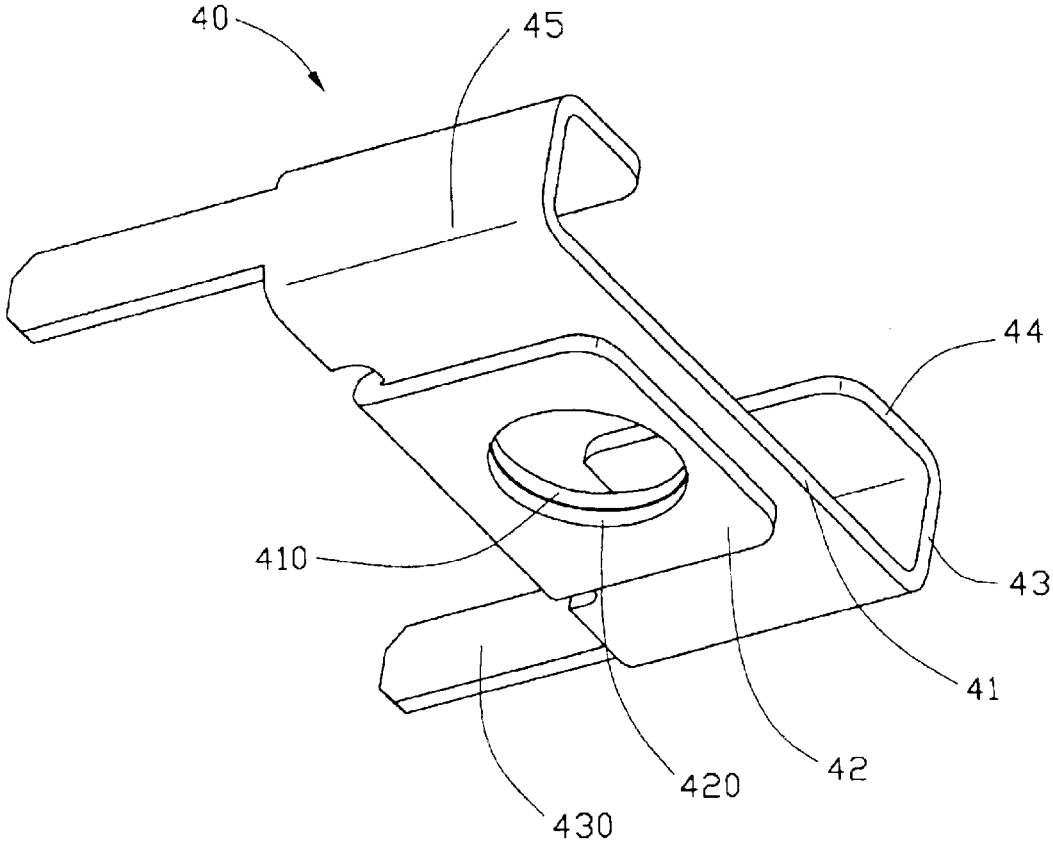
FIG. 3 is a view similar to FIG. 2 but taken from a different aspect.

Referring to FIGS. 2 and 3, the retention structures 40 are stamped and formed from sheet metal. Each retention structure 40 comprises a body portion 45 and a pair of extensions 430 extending from the body portion 45. The body portion 45 comprises a main plate 41 having a hole 410, a folded plate 42 bending downwardly from an inner side of the main plate 41 and extending outwardly, a pair of side portions 43 extending vertically and upwardly from two opposite sides of the main plate 41, and a pair of upper portions 44 extending horizontally toward each other from top ends of the two side portions 43 respectively. The folded plate 42 is substantially parallel to the main plate 41 and defines a hole 420 corresponding to the hole 410 of the main plate 41. The upper portions 44 are parallel to the main plate 41 to define a pair of receiving space 411 therebetween. The two extensions 430 extend inwardly from the two side portions 43 respectively.

Figure 4:
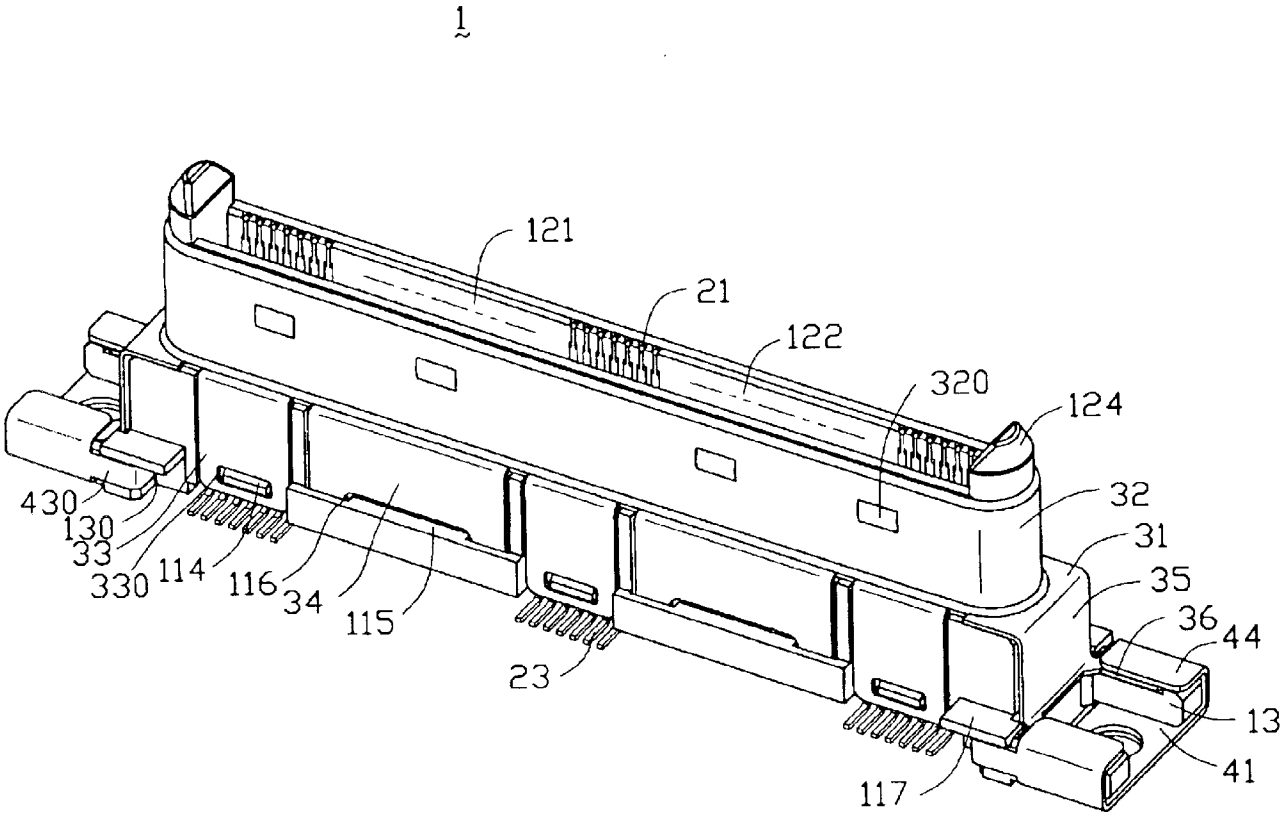
FIG. 4 is an assembled perspective view of the electrical connector of FIG. 1.

Referring to FIG. 4, in assembly, the electrical terminals 20 are assembled to the insulative housing 10 from the bottom face 111 of the base 11 with the contact portions 21 received in the passageways 123 on the two opposite side walls 122 of the slot 121, the retention portions 22 engaged with the base 11 and the tail portions 23 extending beyond the side faces 112 of the base 11. The metallic shell 30 is assembled to the insulative housing 10 with the mating port 32 surrounding the mating portion 12, the main portion 31 and the vertical plates 35 covering the upper face 110 and the end faces 133 of the base 11 respectively. The latch tabs 33 and clips 34 extend downwardly along the side faces 112 of the base 11. The projections 114 engage with the openings 330 of the latch tabs 33 and the protrusions 340 of the clips 34 are received in the slits 116 of the flanges 115 to fix the metallic shell 30 to the insulative housing 10.

The retention structures 40 are assembled to the insulative housing 10 from two opposite ends of the base 11 along the longitudinal direction thereof. The support portions 13 are received in the receiving spaces 411 of the retention structures 40. The two upper portions 44 are located on the support portions 13 and the main plate 41 is located under the support portions 13, thus respectively vertically clamping the upper and lower sides of the pair of support portions 13 to cooperatively prevent the retention structure 40 from vertically moving relative to the support portions 13. The two side portions 43 of each retention structure 40 clamp the outer sides of the pair of support portions 13 to prevent the retention structure 40 transversally move relative to the support portions 13. The extensions 430 are bent to engage with the depressed portions 130 of the insulative housing 10 to prevent the retention structures 40 from disengaging the support portions 13 in the longitudinal direction of the base 11. Therefore, the retention structures 40 are fixed to the insulative housing 10 reliably, The resilient tabs 360 abut against the upper portions 44 of the retentions structures 40 to electrically connect the metallic shell 30 and the retention structures 40.

It is to be understood, the side portions 43 and the upper portions 44 can extend not vertically and horizontally respectively. The side portions 43 and the upper portions 44 can be configured to correspond to the support portions 13 of the insulative housing 10. For example, when the support portions 13 are cylindrical configuration, the side portions 43 and the upper portions 44 of the retention structures 40 are then formed to arc configuration to conform with the extensions 13. The pair of extensions 430 of each retention structure 40 can also extend inwardly from the main plate 41 or the two upper portions 44 respectively;

When the electrical connector 1 is mounted to a printed circuit board (not shown), screws (not shown) pass through the holes 410, 420 on the main plates 41 and the folded plates 42 and the screw-holes in the printed circuit board to be fastened to the printed circuit board, so the electrical connector 1 is secured to the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a plurality of passageways, a pair of support portions extending from an end thereof in a longitudinal direction and spaced apart from each other, a pair of plates extending outwardly from two opposite side faces thereof in a direction which is perpendicular to the longitudinal direction, and a pair of depressed portions under the pair of plates and adjacent to the pair of support portions, each support portion having an upper side, a lower side opposite to the upper side and an outer side;

a plurality of electrical terminals received in the passageways of the insulative housing; and a retention structure comprising a body portion and a pair of extensions extending from the body portion and engaging with the pair of depressed portions of the insulative housing, the body portion comprising a main plate, a pair of side portions extending from two opposite sides of the main plate, a pair of upper portions extending toward each other from the pair of side portions, the two upper portions and the main plate clamping the upper and lower sides of the two support portions, the two side portions clamping the outer sides of the two support portions.

2. The electrical connector as claimed in claim 1, wherein the main plate defines a hole.

3. The electrical connector as claimed in claim 2, wherein the body portion comprises a folded plate bending downwardly from an inner side of the main plate and extending outwardly.

4. The electrical connector as claimed in claim 3, wherein the folded plate is substantially parallel to the main plate and defines a hole corresponding to the hole of the main plate.

5. The electrical connector as claimed in claim 1, wherein the side portions extend vertically and upwardly from the opposite sides of the main plate.

6. The electrical connector as claimed in claim 1, wherein the upper portions extend horizontally from the top ends of the two side portions.

7. The electrical connector as claimed in claim 1, wherein the insulative housing comprises a second pair of support portions extending therefrom, and wherein the electrical connector comprises a second retention structure mounted to the second pair of support portions.

8. The electrical connector as claimed in claim 1, wherein the insulative housing comprises an elongated base having an upper face, a bottom face opposite to the upper face, two opposite side faces and two opposite end faces, and a mating portion extending upwardly from the upper face of the base and having a top face.

9. The electrical connector as claimed in claim 8, wherein the mating portion is provide with a pair of guide posts on two opposite ends thereof and extending upwardly beyond the top face thereof.

10. The electrical connector as claimed in claim 8, wherein the mating portion defines a slot extending downwardly form the top face along a longitudinal direction thereof, and wherein the passageways are defined on two opposite side walls of the slot and extend downwardly through the base.

11. The electrical connector as claimed in claim 10, wherein each electrical terminal comprises a contact portion received in the passageway, a retention portion extending downwardly from the contact portion and engaging with the base, and a tail portion extending from the retention portion and beyond the side face of the base.

12. The electrical connector as claimed in claim 8 further comprising a metallic shell having a main portion covering the upper face of the base, a mating port extending upwardly from the main portion and surrounding the mating portion of the insulative housing, a pair of vertical plates extending downwardly from two opposite ends of the main portion and covering the two opposite end faces of the base.

13. The electrical connector as claimed in claim 12, wherein the metallic shell comprises a plurality of latch tabs extending downwardly from two opposite sides of the main portion and along the two opposite side faces of the base, each latch tab having an opening, and wherein the base is formed with a plurality of projections on the two opposite side faces thereof and engaging with the opening of the latch tabs.

14. The electrical connector as claimed in claim 12, wherein the metallic shell comprises a plurality of clips extending downwardly from two opposite sides of the main portion and along the two opposite side faces of the base, each clip having a pair of protrusions projecting downwardly from two opposite ends thereof, and wherein the base is formed with a plurality of flanges on the two opposite side faces thereof, each flange defining a pair of slits on opposite ends thereof to receive the protrusions of the clips.

15. The electrical connector as claimed in claim 12, wherein each support portion defines a groove, and wherein the metallic shell comprises a pair of contact plates extending outwardly from a bottom end of a vertical plate along a longitudinal direction and being received in the grooves of the support portions.

16. The electrical connector as claimed in claim 15, wherein each contact plate has a resilient tab stamped therefrom and extending upwardly and abutting against the upper portions of the retention structure to electrically connect the metallic shell and the retention structure.

17. An electrical connector comprising:

an insulative housing defining an elongated base with two pairs of support portions at two opposite ends thereof;

a plurality of terminals disposed in the housing;

a pair of retention structures respectively attached to the corresponding pair of support portions, each of said retention structures defining a main plate abutting against an underside of the corresponding pair of support portions, two side portions extending from the main plate and abutting against two opposite exterior sides of the corresponding pair of support portions, and two upper portions extending from the two side portions and abutting against an upper side of the corresponding pair of support portions, such that each of said retention structures securely grasps the corresponding pair of support portions; and a folded plate reversely extending from and located under the main plate; wherein the main plate defines a first through hole, and the folded plate defines a second through hole in vertical alignment with said first hole.

18. The connector as claimed in claim 17, wherein each of said retention structures further includes an extension which is inwardly bent to be engaged within a corresponding depressed portion in the housing.

19. A method of assembling an electrical connector, comprising steps of:

providing an insulative housing with an elongated base along a longitudinal direction and two pairs of support portions at two opposite ends thereof;

disposing a plurality of terminals in the housing;

attaching a pair of retention structures respectively to the corresponding pairs of support portions along said longitudinal direction, each of said retention structures defining a main plate with two side portions extending therefrom, and two upper portions extending from the two side portions, respectively, such that each of said retention structures securely grasps the corresponding pair of support portions with movement in said longitudinal direction relative to the housing; and bending a pair of extensions to be engaged within depressed portions in the housing for preventing movement of the retention structures relative to the housing along said longitudinal direction, wherein said pair of extensions are respectively integrally formed with the corresponding retention structures and are originally not inwardly bent for casing assembling.

* * * * *